US007895705B2

(12) United States Patent
Kim

(10) Patent No.: US 7,895,705 B2
(45) Date of Patent: Mar. 1, 2011

(54) STEAM CLEANING APPARATUS AND METHOD OF DRIVING THE SAME

(76) Inventor: Tae-Young Kim, Goyang-si (KR)

( * ) Notice: Subject to any disclaimer, the term of this patent is extended or adjusted under 35 U.S.C. 154(b) by 562 days.

(21) Appl. No.: 11/975,732

(22) Filed: Oct. 18, 2007

(65) Prior Publication Data

US 2008/0120800 A1 May 29, 2008

(30) Foreign Application Priority Data

Nov. 27, 2006 (KR) ..... 10-2006-0117412

(51) Int. Cl.
*B08B 3/02* (2006.01)

(52) U.S. Cl. ..... 15/319; 134/18; 134/36; 122/40; 122/361; 122/379; 239/128

(58) Field of Classification Search ..... 15/319; 122/40, 361, 379, DIG. 10; 134/18; 239/128; 392/404, 476
See application file for complete search history.

(56) References Cited

U.S. PATENT DOCUMENTS 2,128,263 A * 8/1938 Ofeldt ..... 239/75
3,773,065 A * 11/1973 Mattox ..... 137/263
3,817,272 A * 6/1974 Finger ..... 137/334
3,915,124 A * 10/1975 Kuhn et al. ..... 122/115
5,029,758 A 7/1991 Chayer
5,800,087 A 9/1998 Tomasik
6,925,968 B1 * 8/2005 Hwang et al. ..... 122/40
2002/0026954 A1 * 3/2002 Tyler et al. ..... 134/37

* cited by examiner

*Primary Examiner*—Steven B McAllister
*Assistant Examiner*—Seth Greenia
(74) *Attorney, Agent, or Firm*—Holland & Hart LLP

(57) ABSTRACT

A steam cleaning apparatus includes water and wax containers to supply water and wax, a pump to discharge a mixture of water and wax, a combustion chamber to receive the discharged mixture in an internal pipe and to spray the mixture through a nozzle such that the mixture can be discharged along the pipe, a burner to heat the pipe of the combustion chamber with a fuel from a fuel container to convert the mixture into steam having high temperature and high pressure, a steam gun to discharge the high temperature and pressure steam from the combustion chamber to an outside, and a controller to control the water container, wax container, pump, combustion chamber, fuel container, and burner and to allow the mixture to be discharged to the outside after being converted to the high temperature and pressure steam. A method of driving the apparatus is also provided.

9 Claims, 8 Drawing Sheets

STEAM CLEANING APPARATUS AND METHOD OF DRIVING THE SAME

BACKGROUND OF THE INVENTION

1. Field of the Invention

The present invention relates to a steam cleaning apparatus and a method of driving the same. More particularly, the present invention relates to a steam cleaning apparatus that can automatically prepare a mixture of water and wax, followed by injecting the mixture into a heated pipe to generate high temperature and pressure steam, which can be used for cleaning the surfaces of various machines including vehicles. Further, the present invention relates to a method of driving such a steam cleaning apparatus.

2. Description of the Related Art

A conventional automatic vehicle cleaning apparatus is of great bulk, expensive, and requires a great amount of water, which causes environmental contamination.

Further, after cleaning a vehicle with the conventional vehicle cleaning apparatus, a separate operation of applying wax to the cleaned surface of the vehicle is optionally performed, which is inconvenient and troublesome for an operator.

Additionally, the conventional cleaning apparatus does not include any managing means with respect to an operator, which inevitably leads to frequently stopping and restarting of the apparatus during a cleaning operation. Moreover, since the conventional apparatus does not include a separate safety protection means, it has problems such as danger attributable to a pressure increase within a pipe, damage of the apparatus and operator attributable to an increase in pressure and temperature of steam, etc.

SUMMARY OF THE INVENTION

The present invention is conceived to solve the problems of the conventional techniques as described above, and an aspect of the present invention is to provide a steam cleaning apparatus that can automatically prepare a mixture of water and wax, followed by injecting the mixture into a heated pipe to generate high temperature and pressure steam, which can be used for cleaning various machines such as vehicles, and a method of driving the same.

It is another aspect of the present invention to provide a steam cleaning apparatus that includes a managing means and a safety protection means for operators to reduce likelihood of damage of the apparatus and operators while increasing operation efficiency, and a method of driving the same.

It is a further aspect of the present invention to provide a steam cleaning apparatus that uses a small amount of water and has a small size, and a method of driving the same.

It is yet another aspect of the present invention to provide a steam cleaning apparatus that can apply wax to an object while cleaning the object, and a method of driving the same.

In accordance with one exemplary embodiment of the present invention, a steam cleaning apparatus includes: a water container and a wax container to accommodate and supply water and wax in response to an operation start instruction, respectively; a pump to discharge a mixture of water and wax supplied from the water container and the wax container; a combustion chamber to receive the discharged mixture in an internal pipe and to spray the mixture through a nozzle such that the mixture can be discharged along the pipe; a burner to heat the pipe of the combustion chamber with a fuel from a fuel container to convert the sprayed mixture into steam having high temperature and high pressure; a steam gun to discharge the high temperature and pressure steam from the combustion chamber to an outside of the apparatus; and a controller to control the water container, wax container, pump, combustion chamber, fuel container, and burner and to allow the mixture of water and wax to be discharged to the outside after being converted to the high temperature and pressure steam. The apparatus may further include an economizer having a serpentine pipe shape configured to receive the mixture discharged from the pipe, wherein the combustion chamber is located below the economizer and includes a pipe coil disposed therein such that flames of the burner are supplied into the pipe coil. The apparatus may further include a blower connected to the burner to blow the flames of the burner into the pipe coil. When injected from the steam gun, the steam may have a temperature of 80.about.90.degree. C. The apparatus may further include a voltage regulator provided to the pump to control a supply amount of water and a discharge amount of steam by regulating revolutions per minute of the pump according to voltage.

Preferably, the water container, the wax container, and the fuel container include a water gauge, a wax gauge, and a fuel gauge, respectively, and the controller detects in real time remaining amounts in the water container, the wax container and the fuel container via the water gauge, the wax gauge and the fuel gauge, and informs visually and audially of a lack of remaining amounts in the water container, the wax container and the fuel container via an external display and an alarm generator.

More preferably, the apparatus further include an automatic controller to control power supply into the apparatus, wherein the automatic controller automatically stops the apparatus by cutting off power supply into the apparatus with a lapse of a predetermined time after the controller informs of the lack of remaining amounts in the water container, the wax container and the fuel container.

More preferably, the apparatus further includes a hydraulic pressure switch disposed at a mixture discharge port of the pump, through which the mixture of water and wax is discharged, to control discharge of the mixture while detecting a hydraulic pressure of the mixture being discharged through the mixture discharge port, and, when the pump and a discharge pipe perform abnormal operations, the controller forcibly suspends discharge of the mixture through the discharge pipe or forcibly cuts off power supply into the apparatus via an automatic controller.

More preferably, the apparatus further includes a steam pressure switch disposed at a steam discharge port, through which steam is discharged from the combustion chamber to the steam gun, to maintain a pressure of the steam in a predetermined range, and a safety valve disposed at the steam discharge port to return the high temperature and pressure steam back to the water container so as to prevent the high temperature and pressure steam from flowing out of the apparatus when the steam has a pressure exceeding the predetermined range.

More preferably, the apparatus further includes an overheat sensor provided to the combustion chamber to detect temperature of the combustion chamber, wherein the controller prevents overheating of the combustion chamber by forcibly supplying water from the water container to the combustion chamber or by cutting off power supply to the apparatus to stop operation of the apparatus in response to a signal from the overheat sensor indicating that the combustion chamber is in an overheated state even after the burner is extinguished.

In accordance with another exemplary embodiment of the present invention, a method of driving a steam cleaning apparatus includes: a) opening a water container and a wax container to prepare a mixture of water and wax in response to an operation start instruction, followed by supplying the mixture into a combustion chamber via a pump; b) igniting a burner to supply flames while operating a blower to guide the flames of the burner to pass through an internal pipe of the combustion chamber; and c) generating high temperature and pressure steam from the mixture passing through a heated pipe coil as soon as the mixture is supplied to the heated pipe coil through a nozzle of the combustion chamber, followed by discharging the steam to an outside of the apparatus through a steam gun.

Preferably, the method further includes, after the step c), determining whether or not the water container, the wax container and a fuel container lack water, wax, and fuel by detecting remaining amounts in the water container, the wax container and the fuel container in real time via a water gauge, a wax gauge and a fuel gauge provided to the water container, the wax container and the fuel container, respectively, followed by informing visually and audially of a lack of water, wax and fuel in the water container, the wax container and the fuel container via an external display and an alarm generator, if the water container, the wax container and the fuel container lack water, wax, and fuel.

More preferably, the method further includes determining whether or not water, wax, and fuel are supplemented into the water container, the wax container and the fuel container, based on detection of the water gauge, the wax gauge and the fuel gauge after informing of the lack of water, wax and fuel, followed by allowing an automatic controller to cut off power supply into the steam cleaning apparatus with a lapse of a predetermined time after determining that the water container, the wax container and the fuel container still lack water, wax, and fuel.

More preferably, the method further includes, after the step c), determining whether or not a hydraulic pressure of the mixture is normal based on real time detection of a pressure of water in the mixture with a hydraulic pressure switch provided to the pump, followed by allowing an automatic controller to cut off power supply into the steam cleaning apparatus, if the hydraulic pressure is abnormal.

More preferably, the method further includes, after the step c), determining whether or not the steam has a normal pressure while controlling a pressure of steam in real time to be maintained at a constant value through signal communication between the controller and a steam pressure switch provided to the combustion chamber, followed by forcibly returning high temperature and pressure steam back to the water container if the steam has a high pressure.

More preferably, the method further includes determining whether or not the combustion chamber is abnormally overheated after the burner is extinguished by suspending driving of the apparatus, based on detection of an overheat sensor provided to the combustion chamber, followed by removing residual heat of the combustion chamber by forcibly supplying water from the water container to the combustion chamber or forcibly stopping the apparatus, if the combustion chamber is abnormally overheated.

BRIEF DESCRIPTION OF THE DRAWING

The above and other objects, features and advantages of the present invention will become apparent from the following description of exemplary embodiments given in conjunction with the accompanying drawings, in which.

DETAILED DESCRIPTION OF THE PREFERRED EMBODIMENT

Exemplary embodiments of the present invention will be described in detail with reference to the accompanying drawings hereinafter.

Figure 1:
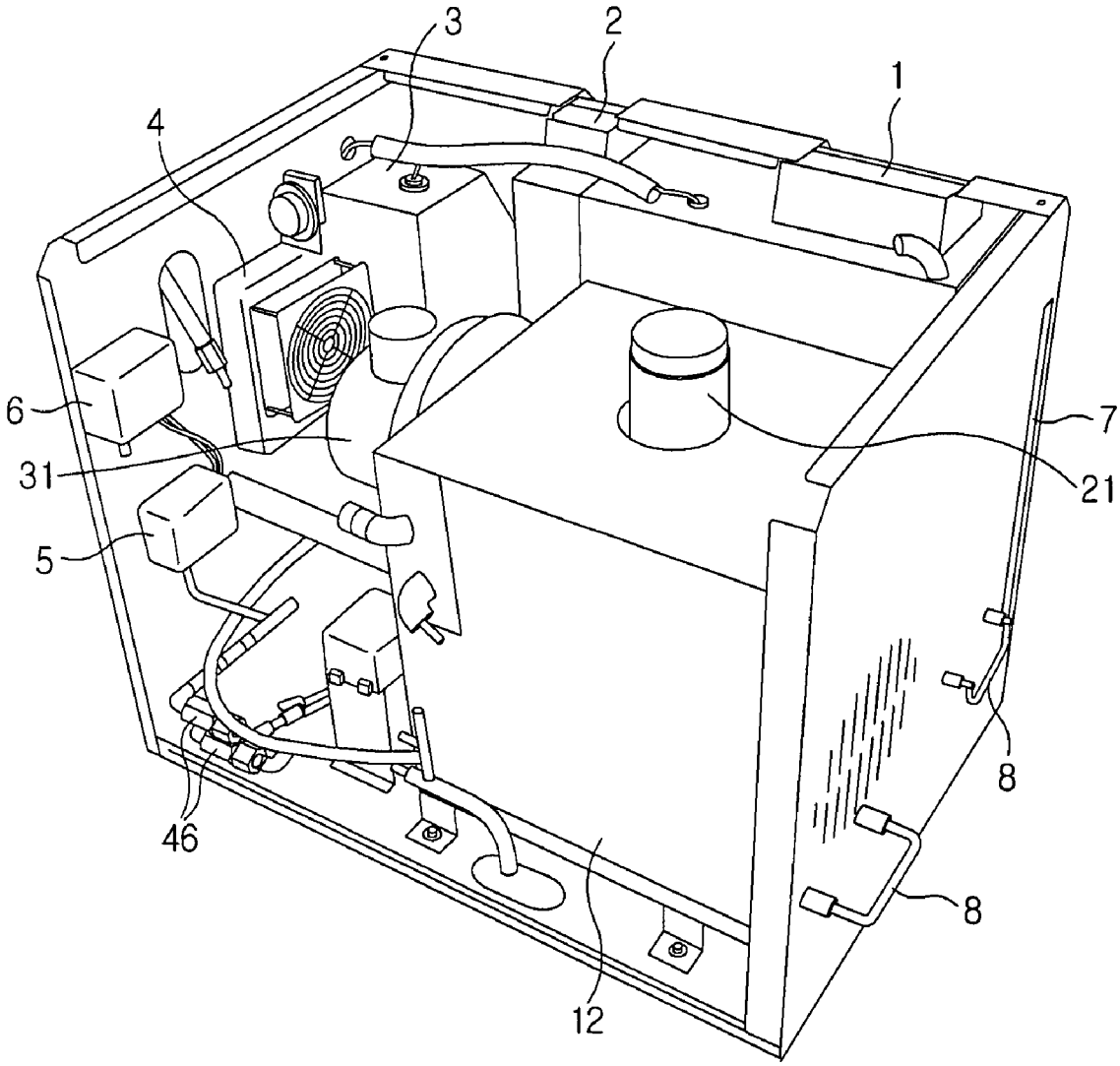
FIG. 1 is a picture of main components of a steam cleaning apparatus according to one embodiment of the present invention.

FIG. 1 is a picture of a steam cleaning apparatus according to one embodiment of the present invention, which is partially open to show an inner configuration.

Referring to FIG. 1, the steam cleaning apparatus includes a water container 1, a wax container 2, and a fuel container 3, each of which is disposed vertically at one side of an upper portion. Water is supplied into the water container 1 through an inlet (not shown) formed at a lower portion of the water container 1. For example, a common tap water hose can be connected to the water container 1 to continuously supply water to the apparatus. The water container 1 may be provided with a level sensor and a level gauge to automatically cut off water supply thereto when water reaches a predetermined level within the water container 1. As shown in FIG. 1, a transparent window is provided at one side of the water container 1 to allow an operator to confirm the water level of the water container from outside. Fuel supplied into the fuel container includes, for example, but is not limited to, diesel oil, gas, etc. A filter 46 is provided to each of supply lines of the wax container and the water container to filter foreign matter from wax and water supplied to a pump or a combustion chamber.

A handle is provided at one side of the apparatus for easy movement of the apparatus.

The fuel container 3 is provided with a heating fan 4, which can be automatically operated depending on temperature and serves to supply heated air into the apparatus when the temperature of the fuel cell decreases below a predetermined temperature, for example, sub-zero temperature, thereby preventing various pumps and hoses disposed inside the apparatus from being damaged in the winter.

A hydraulic pressure switch 5 and a steam pressure switch 6 are disposed near the heating fan 4. Function of these components will be described below along with those of other components. It should be noted that locations of the aforementioned components are not important in this invention, and these components can be disposed at any other locations.

The steam pressure switch 6 is a switch to control the pressure of steam generated in the apparatus to be maintained in a predetermined range, and the hydraulic pressure switch 5 is a switch (sensor) to control the pressure of water supplied from the water container.

Figure 2:
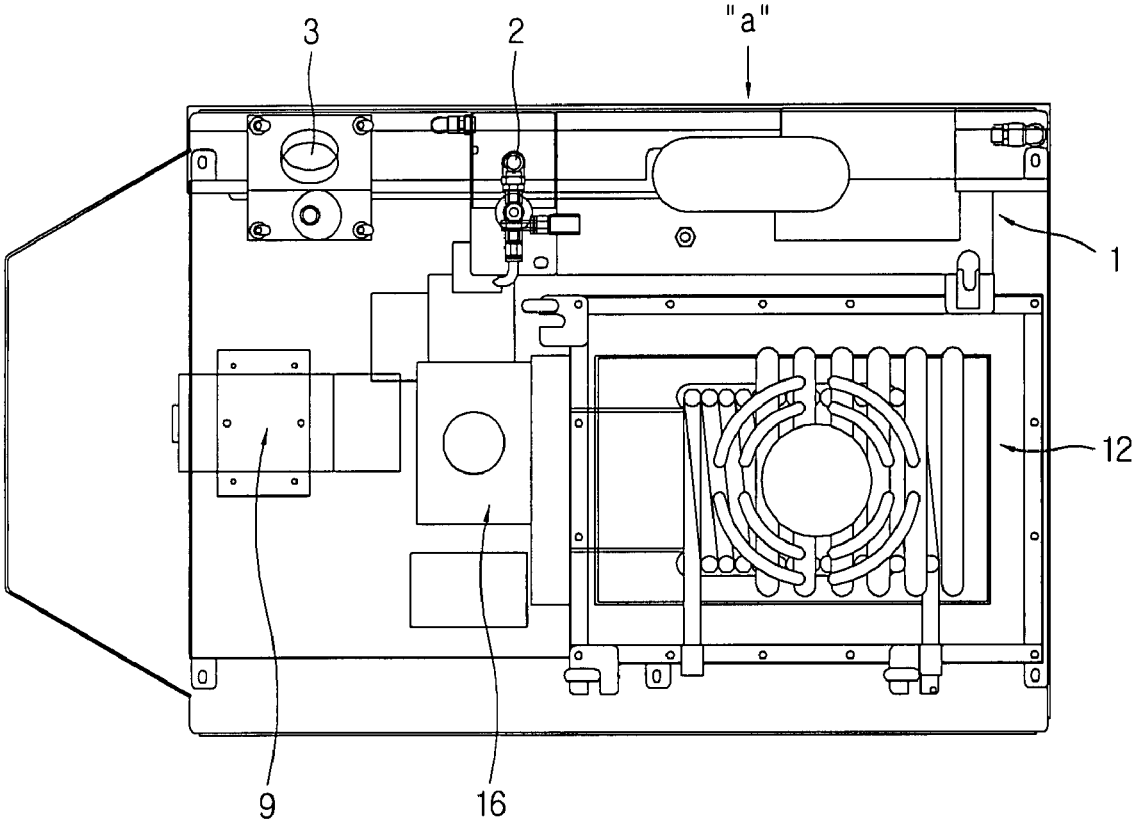
FIG. 2 is a top view of the steam cleaning apparatus of FIG. 1.

FIG. 2 is a top view of the steam cleaning apparatus of FIG. 1.

Referring to FIG. 2, water is supplied from the water container 1 to a combustion chamber 12 by a pump 9. The combustion chamber 12 is heated by a burner 16.

Figure 3:
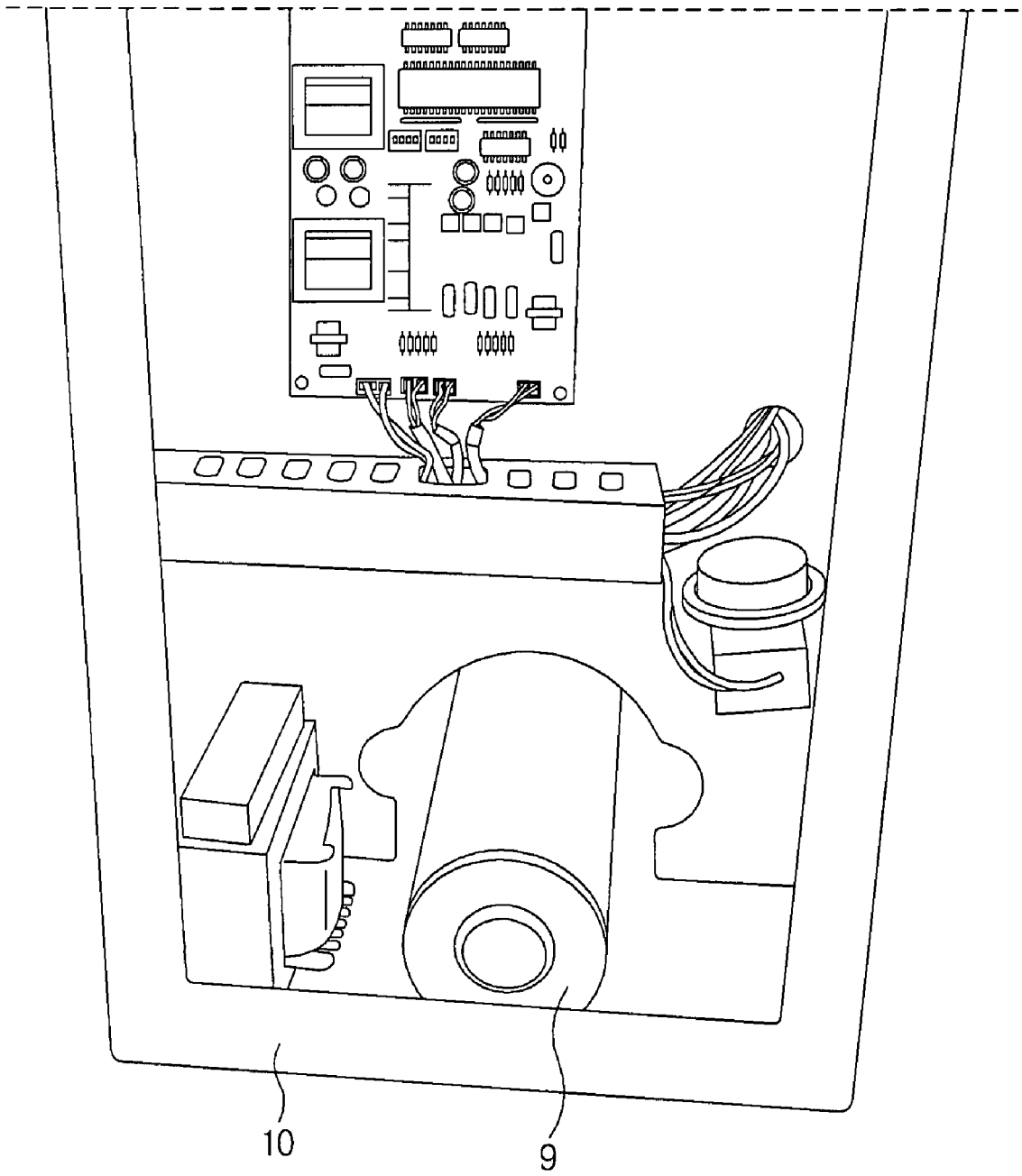
FIG. 3 is a picture of an inner configuration of the steam cleaning apparatus, showing a pump 9 of the apparatus.

FIG. 3 is a picture of the apparatus taken from a right side of FIG. 2, in which the apparatus is partially disassembled.

A voltage regulator 10 is disposed at one side of the pump 9. The voltage regulator 10 serves to regulate a water supply amount and a steam discharge amount by controlling revolutions per minute of the pump 9. In other words, the voltage regulator 10 controls the RPM of a motor in the pump 9 according to voltage.

Figure 4:
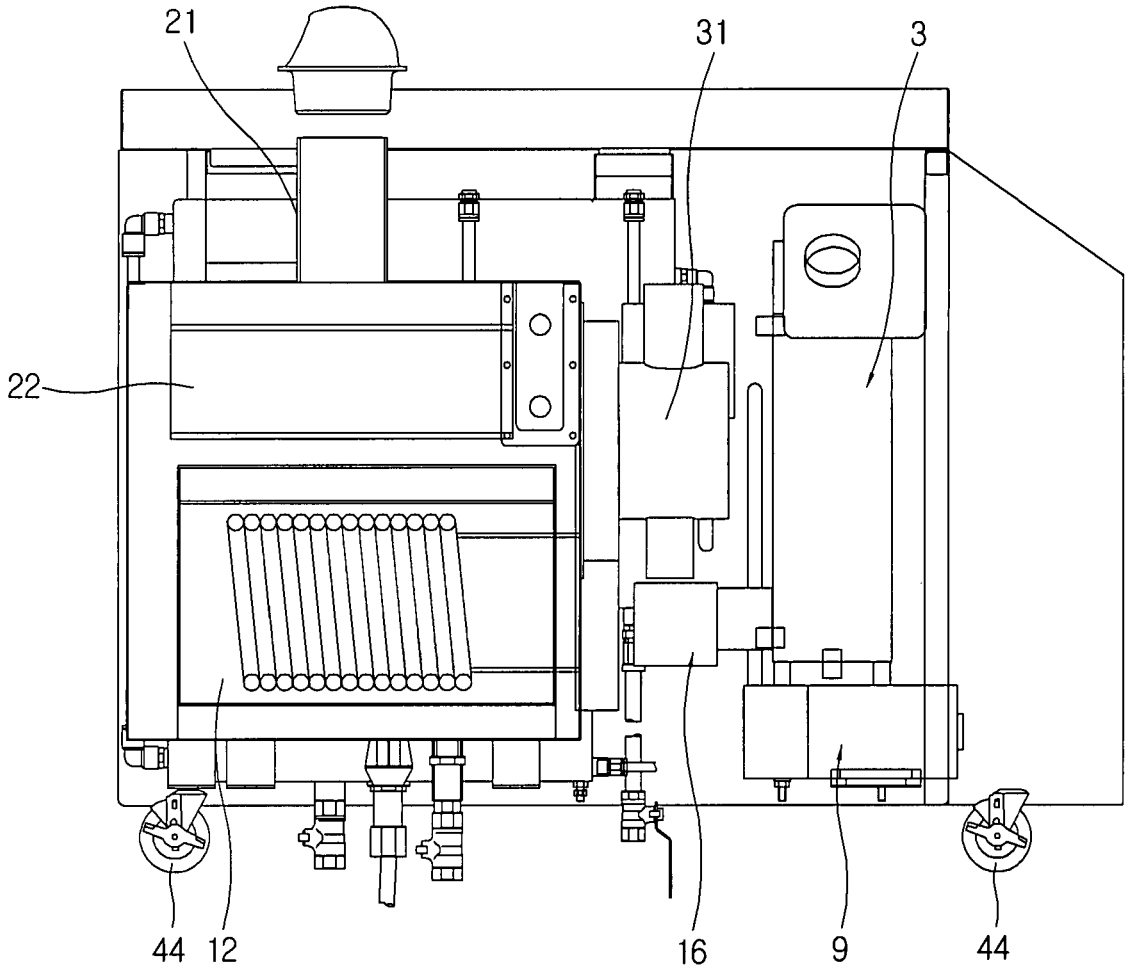
FIG. 4 is a side view of the inner configuration of the apparatus seen in a direction of arrow "a" of FIG. 2.

FIG. 4 is a side view of the apparatus seen in a direction of arrow "a" of FIG. 2.

A discharge duct 21 is located on top of the combustion chamber 12 to exhaust gas from the combustion chamber 12. The apparatus has wheels 44 coupled to a lower surface thereof for easy movement of the apparatus.

Figure 5:
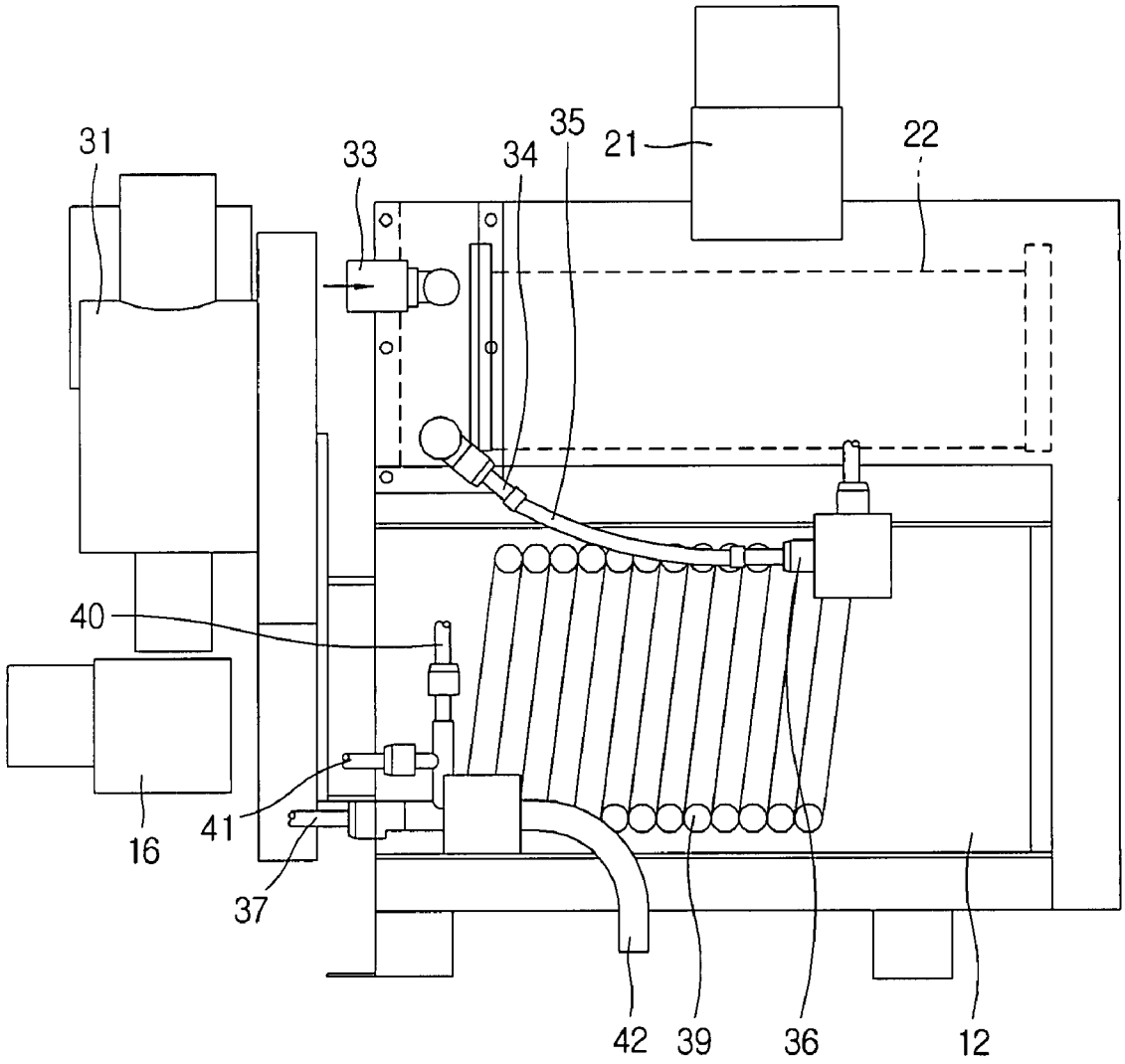
FIG. 5 is an explanatory view of a combustion chamber and related components in the steam cleaning apparatus.

FIG. 5 shows connection structure between the components such as the combustion chamber 12, the burner 16 and the like inside the apparatus of FIG. 4.

As shown in the drawings, water flows from the water container 1 of FIG. 2 into a water supply pipe 33 shown in FIG. 5 via the pump 9. Then, water flows into a pipe coil 39 through a steam connection port 36 after sequentially passing through a an economizer 22, a connection duct 34, and a connection pipe 35. As a result, water is converted into steam, which in turn is discharged to an outside through a discharge port 37 of the pipe coil 39. The economizer 22 has a serpentine copper pipe disposed therein. The burner 16 is disposed in front of the combustion chamber 12 such that flames of the burner 16 are supplied into the center of the stainless pipe coil 39 by means of a blower 31 to heat steam generated in the pipe coil 39. Generation of steam will be described hereinafter.

While water flows in the economizer after being injected through a nozzle, the pipe coil is preheated by the burner. Thus, water is converted to steam as soon as the water is injected into the heated pipe coil.

At this time, after heating the pipe coil, waste heat can remain and secondarily heat the economizer 22, providing effect of preheating water flowing in the water supply pipe 33, which is conducive to an increase in thermal efficiency via momentary conversion of water into steam. Exhaust gas is discharged to the outside through the duct 21.

The discharge port 37 is connected to a steam gun 59 (see FIG. 6) to discharge steam. The discharge port 37 is connected at an upper side with two pipes, one of which is a pressure gauge pipe 40 connected to the pressure gauge to measure the pressure of steam, and the other is a pressure switch pipe 41 connected to a pressure switch (not shown) and turning on or off the pressure switch depending on the pressure. The discharge port 37 is connected at a lower side with a drain pipe 42 that will acts as a drain.

Figure 6:
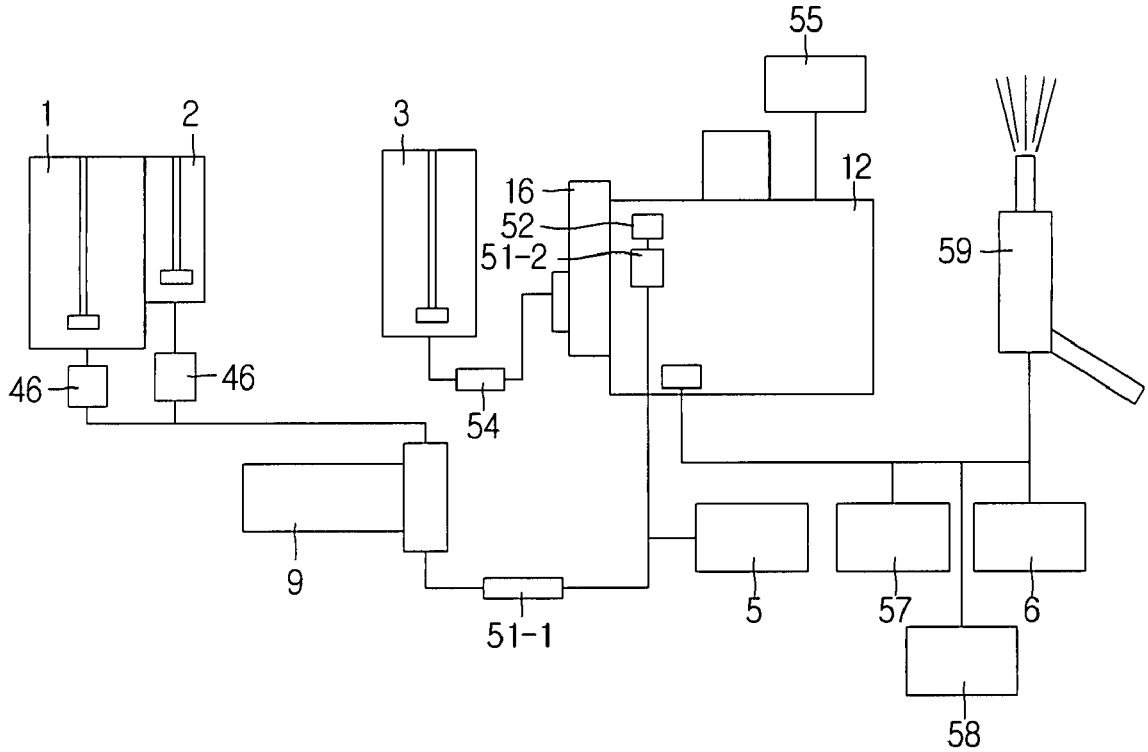
FIG. 6 is a conceptual view of the overall configuration of the steam cleaning apparatus.

FIG. 6 is a conceptual view illustrating the overall configuration of the steam cleaning apparatus.

Referring to FIG. 6, operation of the steam cleaning apparatus according to the embodiment of the invention will be described hereinafter.

After being supplied from the water container 1 and the wax container 2, respectively, water and wax enter the pump 9 through the filters 46 to prepare a mixture. The water and wax are mixed, for example, at a ratio of about 50:1, by the size of the nozzle. The mixture passes through the pump 9 and a check valve 51, and is sprayed into the combustion chamber 12 via a nozzle 52. When sprayed into the combustion chamber 12, water is sprayed in the form of small water particles as in vapor such that the sprayed small water particles can be converted to steam with a relatively small heat quantity, as soon as they enter the pipe coil 39 heated by the burner 16, thereby enabling injection of high temperature and pressure steam.

In order to generate steam using water supplied from a predetermined container, the water must be heated to boiling point or more, which requires great consumption of time and energy. Further, if steam has a temperature of 100° C. or more when discharged from the steam gun, it can damage the surface of a cleaning target such as vehicles, and it can be difficult and dangerous to form and treat such high temperature steam in a moment.

Fuel in the fuel container 3 includes gas, diesel oil, etc., and is burnt within the burner 16 after being supplied thereto through a fuel filter 54. The combustion chamber 12 is provided with an overheat sensor 55 to prevent overheating of the combustion chamber 12. After being heated in the combustion chamber 12, steam is sprayed by the steam gun 59.

The hydraulic pressure switch 5 is disposed between a check valve 51-1 and a check valve 51-2 to send signals indicating normality or abnormality of the pump and pipes to the controller. A safety valve 57, the steam pressure switch 6, and a pressure gauge 58 are disposed near the combustion chamber 12 to control the pressure of steam discharged from the combustion chamber 12 to be maintained in a predetermined range and to display a current pressure of steam.

With the steam cleaning apparatus as described above, it is possible to clean a cleaning target only with water without supplying wax, if desired.

On the other hand, extended use of the apparatus generally causes residual heat of high temperature to remain even after the burner is extinguished. Therefore, to remove such residual heat, the apparatus is configured to forcibly supply water into the combustion chamber without operating the burner, which prevents the combustion chamber from being overheated, so that lifetime of the apparatus can be extended.

Figure 7:
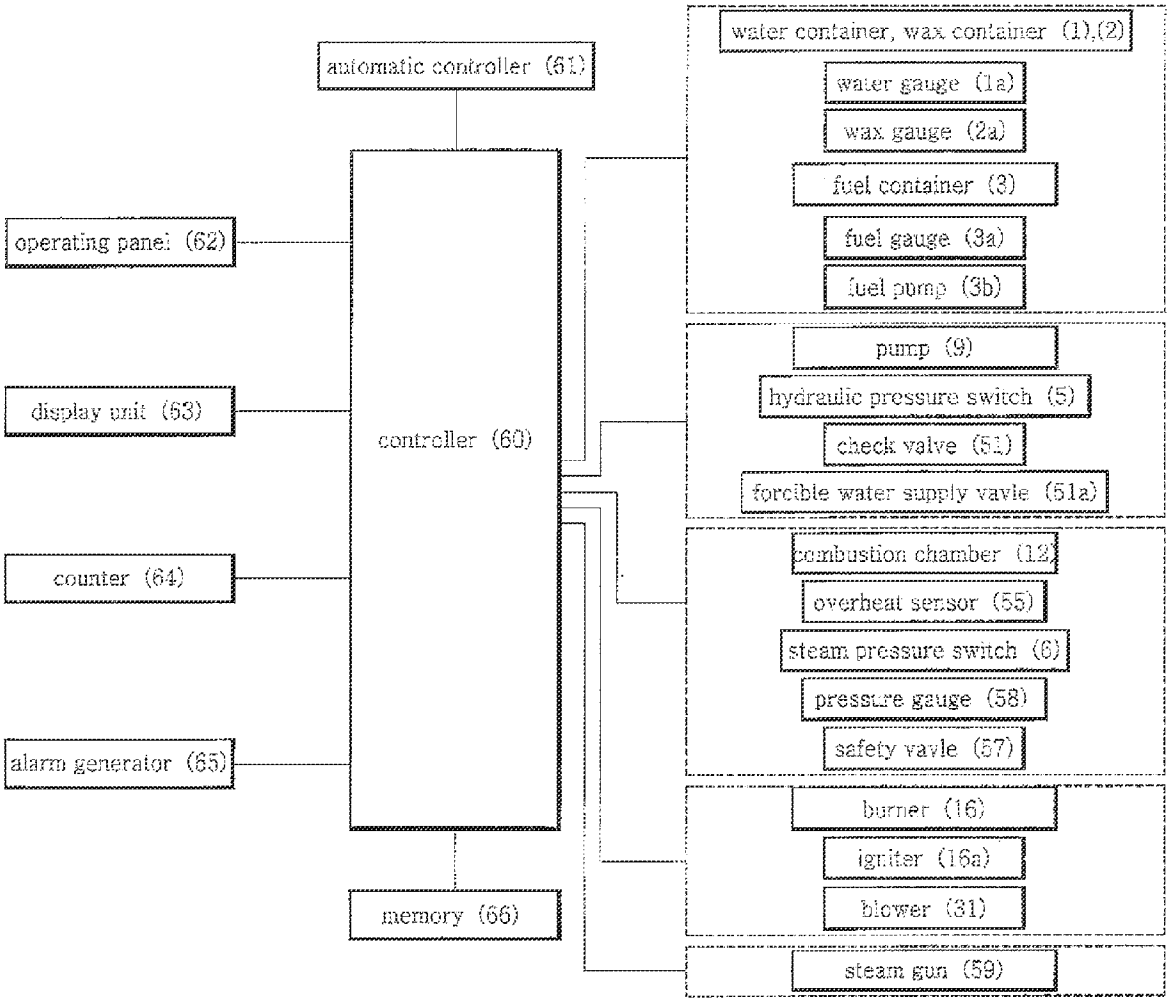
FIG. 7 is a block diagram of an overall operation for controlling respective components of the steam cleaning apparatus.

Now referring to FIG. 7, a control operation of respective components of the steam cleaning apparatus will be described in detail hereinafter.

Generally, an internal construction for controlling the steam cleaning apparatus includes an automatic controller 61, an operating panel 62, a display unit 63, a counter 64, an alarm generator 65, a memory 66, and a controller 60, which controls these components. With these components, the controller 60 enables preparation and supply of a mixture of water and wax, heating of the mixture, and generation, discharge and maintenance of steam via signal communication with the water container 1, wax container 2, fuel container 3, pump 9, burner 16, combustion chamber 12, nozzle 52, and steam gun 59.

In the event where the apparatus undergoes electrical problems, such as a short circuit, or other abnormal operation of the components, the automatic controller 61 works to automatically stop driving the steam cleaning apparatus by cutting off power from an exterior.

Here, conditions of the automatic controller 61 for cutting off power supply to the apparatus include, for example, but are not limited to, water depletion in the water container 1, wax depletion in the wax container 2, fuel depletion in the fuel container 3, abnormal operation of pipes connected to the pump 9 and the combustion chamber 3, overheating or excessive pressure (for a gas type cleaning apparatus, gas leakage), etc. Under any one of these conditions, the automatic controller controls a circuit breaker to be cut off, and allows power supply to the apparatus only after reasons of such conditions are completely removed.

The operating panel 62 is an external operating panel which is used by a user to drive the steam driving apparatus, and includes an operating switch to start operation of the apparatus, a flux regulation switch to regulate an amount of moisture in steam, a steam supply regulation switch to regulate a steam discharge amount, etc.

The display unit 63 is to show current driving conditions of the steam cleaning apparatus, and includes water/wax depletion display lamps, an overheating display lamp, a pumping display lamp, an ignition display lamp, a power application display lamp, etc., all of which can be made of light emitting diodes.

The counter 64 checks a time period of controlling the components in the steam cleaning apparatus.

The alarm generator 65 outputs an alarm sound to inform a user of any of abnormality that can occur in the steam cleaning apparatus.

At this time, even in the event where the steam cleaning apparatus undergoes any of abnormal circumstances in any of the components, the user can recognize the abnormal circumstance doubly through the display unit 63 and the alarm generator 65, while the automatic controller 61 automatically cuts off power supply to the apparatus, thereby stopping the operation of the associated component and preventing malfunction of the component in such a circumstance.

For example, if the apparatus is in the water depletion condition of the water container 1 among various abnormal circumstances as described above, the display unit 63 and the alarm generator 65 visually and audially inform the user of water depletion before water reaches a preset minimum level (for example, before 5 minutes) in the water container 1, and, when it reaches the preset minimum level, the automatic controller 61 automatically stops operations of all associated components, so unnecessary supply of wax and operation of the burner can be stopped, thereby preventing damage of the components and discharge of steam incompletely formed.

The memory 66 stores various kinds of data, such as data for operation of the apparatus, data for suspending the operation of the apparatus, data for second best operation of the apparatus (which will be described below) to allow the apparatus to be operated in optimum conditions.

On the other hand, the water container 1 and the wax container 2 are provided with a water gauge 1*a* and a wax gauge 2*a*, respectively. Both of the water gauge 1*a* and the wax gauge 2*a* include level sensors to detect current amounts of water and wax in the water and wax containers 1 and 2, which are informed to the controller 60.

Based on such detections of the current amounts of water and wax via the water gauge 1*a* and the wax gauge 2*a*, the controller 60 recognizes current circumstances of the water and wax containers 1 and 2, and automatically suspends driving of associated components upon depletion of water or wax therein while informing the user of such depletion of water or wax through the display unit 63 and the alarm generator 65 as described above.

The fuel container 3 is provided with a fuel gauge 3*a* and a fuel pump 3*b*. The fuel gauge 3*a* includes a level sensor, and sends to the controller 60 a measurement result of a current amount of oil in the fuel container 3. The fuel pump 3*b* supplies fuel from the fuel container 3 to the burner 16 in response to a control signal from the controller 60.

The hydraulic pressure switch 5 is disposed at a mixture discharge port of the pump 9, through which the mixture of water and wax is discharged to the combustion chamber 12.

The hydraulic pressure switch 5 includes a pressure sensor and sends to the controller 60 a measurement result of the pressure of water in the mixture discharged through the mixture discharge port of the pump 9.

When the pump 9 and the pipe connected to the combustion chamber 12 exhibit an abnormal condition (for example, abnormal hydraulic pressure), the hydraulic pressure switch 5 sends signals of the abnormal condition to the controller, and stops the apparatus.

That is, when detecting the abnormal condition of water discharged through the pump 9 and the pipe, the hydraulic pressure switch 5 sends a signal indicating the abnormal condition of the pump 9 and the pipe to the display unit via the controller 60 to stop the overall operation of the steam cleaning apparatus, which ensures protection of the apparatus and safety of the user.

The pump 9 is provided with a forcible water supply valve 51*a* to forcibly supply water into the combustion chamber 12 in order to remove the residual heat of the combustion chamber 12 when the combustion chamber 12 is overheated even after the burner 16 is extinguished. With this construction, the combustion chamber 12 is prevented from being overheated, thereby extending lifetime of the apparatus. In detail, as described above, the overheat sensor 55 is provided to the combustion chamber 12 to detect the temperature thereof, and, if it is determined via the overheat sensor 55 that the temperature of the combustion chamber 12 is excessively high even after the burner 16 is extinguished, the controller 60 opens the forcible water supply valve 51*a* and allows water to be forcibly supplied from the water container 1 to the combustion chamber 12 through the pump 9.

Meanwhile, the burner 16 is provided with an igniter 16*a* to ignite the burner 16, and an ignition state of the burner 16 by the igniter 16*a* is displayed on the display unit 63 through the controller 60.

The combustion chamber 12 is provided with the steam pressure switch 6 to control the pressure of steam discharged from the combustion chamber 12 as well as the overheat sensor 55 for detecting the temperature of the combustion chamber 12 as described above. The steam pressure switch 6 sends a signal to the controller to maintain a constant pressure of steam in connection of the pressure switch, and then the controller controls the temperature of the burner and the operation of the pump to maintain the constant pressure.

In practice, steam having an abnormal pressure (high pressure) is likely to be discharged to the outside, which is dangerous to the user.

Accordingly, the safety valve 57 is disposed at a steam discharge port, through which steam is discharged to the outside, and is operated to return high pressure steam back into the apparatus when the steam has a high pressure above the predetermined range.

That is, the safety valve 57, designed to operate when the pressure of steam exceeds a predetermined range, allows high temperature and pressure steam to be safely treated within the apparatus without being discharged to the outside by returning the high temperature and pressure steam back to the water reservoir via a separate pipe (not shown).

Figure 8:
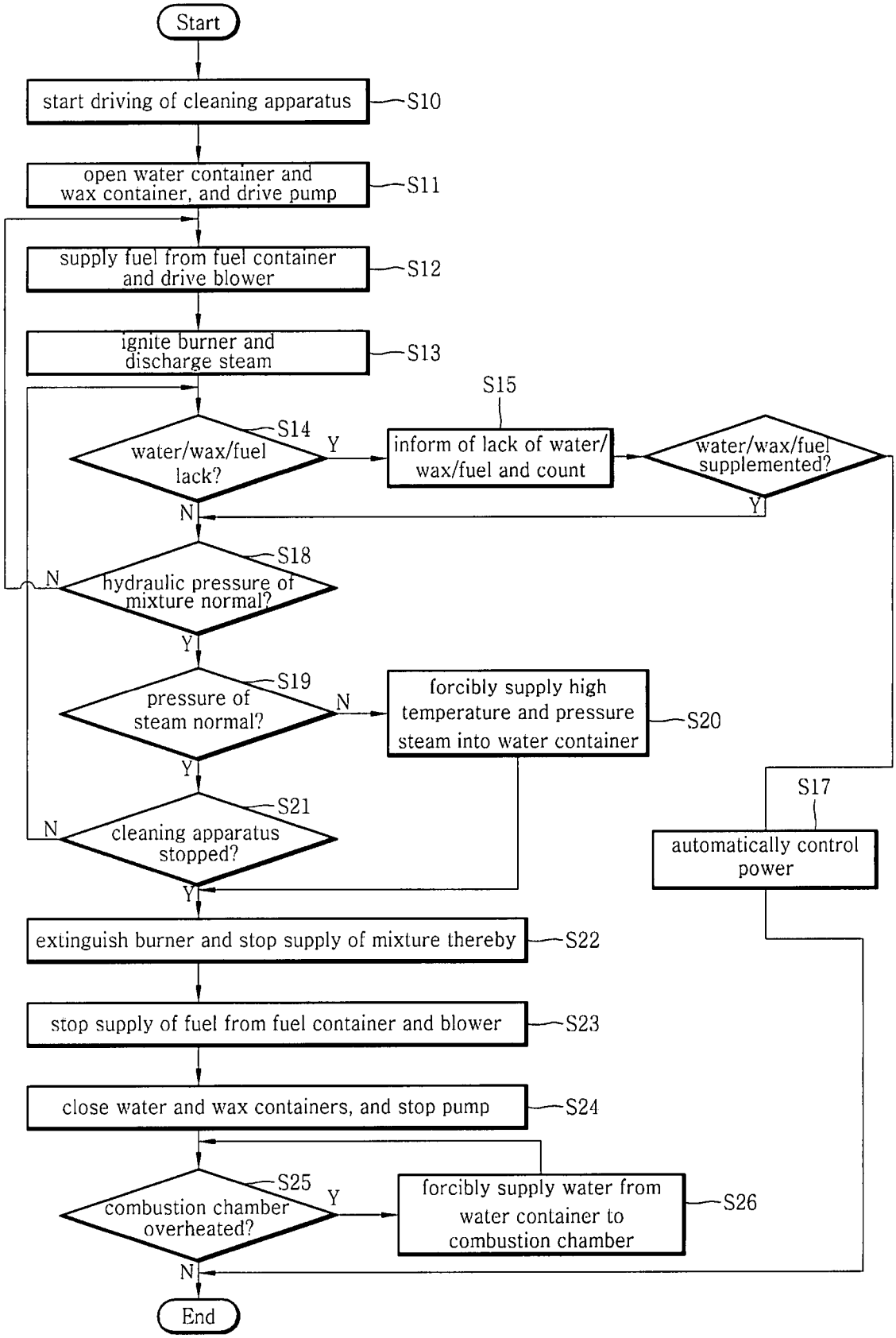
FIG. 8 is a flow chart of a method of driving a steam cleaning apparatus according to one embodiment of the present invention.

Now referring to FIG. 8, an overall control flow of the steam cleaning apparatus will be described.

First, when an operating switch on the operation panel 62 is turned on to drive the steam cleaning apparatus by a user (S10), the controller 60 opens the water container 1 and the wax container 2 to prepare a mixture of water and wax, and drives the pump 9 to force the mixture to be supplied into the combustion chamber 12 (S11). Further, the controller 60 opens the fuel container 3 while driving the blower 31 and the fuel pump 3*b* to supply fuel from the fuel container 3 to the burner 16 (S12).

Additionally, the controller 60 ignites the igniter 16*a* of the burner 16 to start the burner 16 to supply flames, which in turn heats the pipe coil 39 while passing through the center of the pipe coil 39 by means of the blower 31, so that the mixture sprayed through a nozzle and passing through the pipe coil is converted into high temperature and pressure steam in the pipe coil and is then discharged by the steam gun 59 (S13).

Then, the controller 60 determines whether or not the water container 1, the wax container 2 and the fuel container 3 lack water, wax and fuel by monitoring remaining amounts of water, wax and fuel in the water container 1, wax container 2 and fuel container 3 in real time through the water gauge 1*a*, wax gauge 2*a*, and fuel gauge 3*a*, respectively (S14). If it is determined that any one of water, wax and fuel is insufficient in the water container 1, the wax container 2 and the fuel container 3, the controller 60 controls the display unit 63 to display such a lack circumstance of water, wax or fuel while informing of the lack circumstance through the alarm generator 65, and counts a time period of lack circumstance of water, wax or fuel by use of the counter 64 (S15).

The time period of lack circumstance of water, wax or fuel is a predetermined period of time (for example, 5 minutes) before a complete depletion of water, wax or fuel, and notification of such lack circumstance of water, wax or fuel will be continued by the display unit 63 and the alarm generator 65 until water, wax or fuel is completely depleted in the water container 1, wax container 2 or fuel container 3.

Next, the controller 60 determines whether or not the water container 1, the wax container 2 and the fuel container 3 are supplemented with water, wax and fuel through the water gauge 1*a*, the wax gauge 2*a*, and the fuel gauge 3*a*, respectively (S16). If the water container 1, the wax container 2 and the fuel container 3 is supplemented with water, wax and fuel, the process proceeds to the next step, whereas if a predetermined period (notification period) elapses in a state that the water container 1, the wax container 2 or the fuel container 3 is not supplemented with water, wax or fuel, the controller 60 forcibly stops driving the apparatus by allowing the automatic controller 61 to cut off all power supply to the steam cleaning apparatus, in order to completely stop driving the steam cleaning apparatus (S17).

Additionally, the controller 60 determines whether or not the pressure of water in the mixture is normal by monitoring the pressure of water in the mixture in real time through the hydraulic pressure switch 5 disposed at the mixture discharge port of the pump 9 (S18). If water in the mixture has an abnormal hydraulic pressure, the controller 60 sends a signal indicating abnormal conditions of the pump and the pipe to the display unit, and controls the automatic controller 61 to cut off power supply to the steam cleaning apparatus, thereby forcibly stopping driving of the apparatus.

Further, the controller 60 controls the pressure of steam discharged from the combustion chamber 12 to be in a predetermined range by means of the steam pressure switch 6 provided to the combustion chamber 12, and determines whether or not the pressure of steam is normal (S19). If steam has an abnormal pressure (especially, high pressure), the controller 60 controls the safety valve 57 to return high temperature and pressure steam back to the water container 1 via a separate pipe such that the high temperature and pressure steam can be safely treated within the apparatus without being discharged to the outside (S20).

Next, the controller 60 determines whether or not a driving-suspension instruction has been given through the operation panel 62 by the user (S21). If the driving-suspension instruction has been given by the user, the controller 60 extinguishes the burner 16 while stopping supply of the mixture (operation of the pump) (S22). Additionally, the controller 60 stops supply of fuel into the fuel container 3 while stopping the blower (S23). Further, the controller 60 suspends preparation of the mixture by stopping the pump (S24).

Here, the controller 60 determines based on detection of the overheating sensor 55 provided to the combustion chamber 12 whether or not the combustion chamber 12 is abnormally overheated (S25). If the combustion chamber 12 is overheated, the controller 60 opens the forcible water supply valve 51*a* and forcibly supplies water from the water container 1 to the combustion chamber 12 through the pump 9 to remove residual heat of the combustion chamber 12 (S26).

Of course, the process of forcibly supplying water in response to a signal indicating overheating of the combustion chamber can be performed during driving of the apparatus.

As apparent from the above description, the steam cleaning apparatus and the method of driving the same according to the present invention can automatically prepare a mixture of water and wax, followed by injecting the mixture into a heated pipe to momentarily generate high temperature and pressure steam, which in turn can be used for cleaning various machines.

The steam cleaning apparatus can inform a user of abnormal operations of respective components through detection of depletion or lack of water, wax and fuel or through detection of abnormal operation of a water pump or a pipe, and automatically stop operation of an associated component with a lapse of a predetermined time thereafter, thereby increasing operation efficiency while ensuring protection of the apparatus, safety of the user, and extension in lifetime of the apparatus.

Further, when steam has an abnormally high pressure, the apparatus returns the steam back to the water container so as not to be discharged to the outside of the apparatus, thereby ensuring the safety of the user while preventing damage of the apparatus.

Further, when residual heat of high temperature remains after the burner is extinguished, the apparatus forcibly supplies water into the combustion chamber to prevent the combustion chamber from being overheated, thereby extending lifetime of the apparatus.

Further, the apparatus can be manufactured to have a small size and a light weight of about 80 kg, and can quickly generate powerful steam within about 30 seconds to 2 minutes so as to be rapidly used in cleaning of a target.

Further, when the apparatus generates steam, the steam has a temperature of about 80~90° C., which ensures high cleaning and high sterilization effects without causing damage to the surface of the target.

Further, since the apparatus has the small size and light weight, it can be conveniently used not only in existing car washes, self car washes or automobile repair shops, but also in home car washes and mobile washing machines.

Further, the apparatus and method of the invention uses water at a small amount of about 300~600 ml per minutes to generate high pressure steam of 7~9 bars, whereas a conventional high pressure cleaning machine requires a great amount of water ranging from 10 to 20 l per minute, thereby contributing to prevention of environmental contamination through water saving and minimization of waste water.

Further, the apparatus and method enables vehicles to be washed with steam, thereby effectively removing foreign matter and smudged dirt from an exterior and an interior of the vehicle.

Further, the apparatus and method enables water and wax to be supplied in a constant ratio such that wax can be automatically diluted with water in a predetermined ratio when supplied into the apparatus to coat the wax on the surface of the vehicle and other products while the vehicle and the like are cleaned, thereby reducing time for cleaning and wax coating.

Of course, the steam cleaning apparatus of the invention can be applied to removal of oily dirt from carpet in vehicles and from other industrial machines without being limited to vehicle washing. Additionally, the apparatus can be applied to steam cleaning of tile corners and the like in outdoor or indoor locations of a hotel, kitchen, toilet, etc.

Although the present invention has been described with reference to the embodiments and accompanying drawings, these embodiments and drawings are given by way of examples. It should be apparent to those skilled in the art that various modifications, additions and substitutions can be made without departing from the scope and spirit of the invention as disclosed in the accompanying claims.

We claim:

1. A steam cleaning apparatus, comprising:

a water container and a wax container to accommodate and supply water and wax in response to an operation start instruction, respectively;

a pump to discharge a mixture of water and wax supplied from the water container and the wax container;

a nozzle to spray the mixture into a pipe of a pipe coil;

a combustion chamber having the pipe coil to receive and to heat the sprayed mixture;

a burner to heat the pipe coil of the combustion chamber with a fuel from a fuel container to convert the sprayed mixture into steam having high temperature and high pressure;

a steam gun to discharge the high temperature and pressure steam from the combustion chamber to an outside of the apparatus;

a controller to control the water container, wax container, pump, combustion chamber, fuel container, and burner and to allow the mixture of water and wax to be discharged to the outside after being converted to the high temperature and pressure steam and to report low levels in the water container, the wax container and the fuel container; and an automatic controller to control power supply into the apparatus, wherein the automatic controller automatically stops the apparatus by cutting off power supply into the apparatus after a predetermined time after the controller informs of the low levels in the water container, the wax container and the fuel container.

2. The apparatus according to claim 1, further comprising:

an economizer having a serpentine pipe shape configured to receive the mixture discharged from the pipe, wherein the combustion chamber is located below the economizer and includes the pipe coil disposed therein such that flames of the burner are supplied into the pipe coil.

3. The apparatus according to claim 1, further comprising:

a blower connected to the burner to blow the flames of the burner into the pipe coil.

4. The apparatus according to claim 1, wherein when injected from the steam gun, the steam has a temperature of 80~90° C.

5. The apparatus according to claim 1, further comprising:

a voltage regulator provided to the pump to control a supply amount of water and a discharge amount of steam by regulating revolutions per minute of the pump according to voltage.

6. The apparatus according to claim 1, wherein the water container, the wax container, and the fuel container include a water gauge, a wax gauge, and a fuel gauge, respectively, and the controller detects in real time remaining amounts in the water container, the wax container and the fuel container via the water gauge, the wax gauge and the fuel gauge, and inform visually and audially of a lack of remaining amounts in the water container, the wax container and the fuel container via an external display and an alarm generator.

7. The apparatus according to claim 1, further comprising:

a hydraulic pressure switch disposed at a mixture discharge port of the pump, through which the mixture of water and wax is discharged, to control discharge of the mixture while detecting a hydraulic pressure of the mixture being discharged through the mixture discharge port, and, when the pump and a discharge pipe perform abnormal operations, the controller forcibly suspends discharge of the mixture through the discharge pipe or forcibly cuts off power supply into the apparatus via the automatic controller.

8. The apparatus according to claim 1, further comprising:

a steam pressure switch disposed at a steam discharge port, through which steam is discharged from the combustion chamber to the steam gun, to maintain a pressure of the steam in a predetermined range, and a safety valve disposed at the steam discharge port to return the high temperature and pressure steam back to the water container so as to prevent the high temperature and pressure steam from flowing out of the apparatus when the steam has a pressure exceeding the predetermined range.

9. The apparatus according to claim 1, further comprising:

an overheat sensor provided to the combustion chamber to detect temperature of the combustion chamber, wherein the controller prevents overheating of the combustion chamber by forcibly supplying water from the water container to the combustion chamber or by cutting off power supply to the apparatus to stop operation of the apparatus in response to a signal from the overheat sensor indicating that the combustion chamber is in an overheated state even after the burner is extinguished.

* * * * *